United States Patent [19]

von der Eltz et al.

[11] Patent Number: 4,701,182

[45] Date of Patent: Oct. 20, 1987

[54] PAD COLD-DWELL PROCESS FOR DYEING WOOL PIECE GOODS WITH REACTIVE DYES UNDER ACID PH

[76] Inventors: Hans-Ulrich von der Eltz; Hans-Peter Maier; Karl-Heinz Röstermundt, all of P.O. Box 80 03 20, D-6230 Frankfurt am Main 80, Fed. Rep. of Germany

[21] Appl. No.: 927,801

[22] Filed: Nov. 5, 1986

[30] Foreign Application Priority Data

Nov. 7, 1985 [DE] Fed. Rep. of Germany ..... 3539475

[51] Int. Cl.[4] ..... D06P 3/82; C09B 62/00; D06B 19/00

[52] U.S. Cl. ..... 8/533; 8/543; 8/549; 8/602; 8/609; 8/917

[58] Field of Search ..... 8/543, 549, 533

[56] References Cited

U.S. PATENT DOCUMENTS

| | | | |
|---|---|---|---|
| 4,139,344 | 2/1979 | von der Eltz | 8/533 |
| 4,304,566 | 12/1981 | von der Eltz et al. | 8/533 |
| 4,444,564 | 4/1984 | Salathe et al. | 8/588 |
| 4,557,731 | 12/1985 | Sasakura et al. | 8/531 |
| 4,560,388 | 12/1985 | Rohrer | 8/543 |
| 4,568,350 | 2/1986 | Rohrer | 8/543 |
| 4,640,691 | 2/1987 | Richter et al. | 8/543 |

FOREIGN PATENT DOCUMENTS 1575948 10/1980 United Kingdom .

*Primary Examiner*—A. Lionel Clingman

[57] ABSTRACT

Hitherto there has been no practical pad-dwell process for wool piece goods which could be carried out without using large amounts of textile assistants. In addition, it has been necessary with all these processes to supply energy. Furthermore, large amounts of urea have always been used, which inevitably resulted in a high degree of waste water pollution. It has now been recognized according to the invention that satisfactory results can be obtained in the dyeing of wool piece goods with reactive dyes by effecting the padding operation with the dye solutions within the pH range from 1.5 to 4 and at room temperature and the subsequent dwell operation to obtain dye fixation without supply of heat. To prevent the formation of a frosting effect and to obtain deeper shades it is expediently possible also to add to the padding liquor nitrogen-containing ethoxylation products, in particular ethoxylated fatty amines, and/or alkyl polyglycol ethers.

13 Claims, No Drawings

PAD COLD-DWELL PROCESS FOR DYEING WOOL PIECE GOODS WITH REACTIVE DYES UNDER ACID PH

The present invention relates to a pad cold-dwell process for dyeing piece goods made of wool or wool-containing fiber mixtures in an acid medium using reactive dyes.

For dyeing textile sheet structures made of wool, the industry, in addition to more or less continuous methods, for example the pad warm-dwell method of German Patent DE-C2 No. 2,635,991, also knows pronounced pad-batchup processes of the type described in German Patent DE-C2 No. 2,635,990 for metal complex dyes and in German Patent DE-C2 No. 2,635,989 for reactive dyes. However, in all the aforementioned processes for dyeing wool piece goods, heat must be supplied either during the padding step or during the dwell step or even during both operations. For instance, in the case of the state of the art revealed by DE-C2 No. 2,635,989, the padding step is carried out at between 60° C. and 80° C. and the dwell temperature subsequently required for fixing the dye is then once more 75° to 85° C.

In addition, the padding liquors used in the dyeing techniques mentioned usually require, in addition to the dyes used, large amounts of hydrotropic substances, in particular urea. Yet the use of urea, which is contemplated to obtain full fixation of the reactive dyes, can lead to certain impairments of the wool material as a consequence of fiber damage. In this context, however, it must not be overlooked that in the hitherto disclosed dyeing processes operated on this basis the waste water is always polluted to a greater or lesser extent. Urea can not be removed again from such contaminated waste waters. As a consequence, the urea fertilizes the plants present in natural water courses and thereby reduces the total oxygen content of rivers and lakes.

The invention explained hereinafter thus has for its object to remedy the abovementioned shortcomings and disadvantages in the dyeing of wool with reactive dyes by the pad-batchup method, in particular to reduce the energy consumption of the actual dyeing process still further and to cut the output of polluted waste waters, if possible. The present-day view is that every kind of energy saving and simple-to-remove waste waters are important.

This object is achieved, then, according to the invention by padding the weblike textile material at a pH between 1.5 and 4, preferably between 2 and 3, and at temperatures up to at most 25° C., preferably in the neighborhood of room temperature, with an aqueous liquor which contains the dissolved reactive dyes and then, to fix the dyes, allowing this padded textile material to dwell for 18 to 36 hours in the moist state under the imported acid conditions and without further heat supply.

The process outlined above has significant advantages in the energy and waste water balance over the state of the art. This is because it was found in the course of the claimed pad-dyeing technique in connection with dye fixation by cold dwell that by maintaining a certain pH range it is possible to dispense with any temperature control altogether. At the same time it is a deliberate decision not to use urea as a fixing assistant for greater depth of shade. The padding liquor thus contains only inorganic or organic acids and/or acid salts thereof, which ensure the setting of the pH range characteristic of the process and which are very simple to neutralize in the course of the treatment of the waste water. The principle of the present invention rests essentially on the presence of a high acid content in the padding liquors used. The new process can be carried out with the industrially required reliability and reproducibility of shade. The remarkable thing about this dyeing process if the simple and uncomplicated method. After a customary finishing of the dye after the dwell step excellent fastness properties are obtained on the wool thus dyed. Extremely brilliant and deep shades are the result. To set acid pH conditions, not only organic but also inorganic acids and salts thereof are possible according to the process. Examples thereof are potassium hydrogensulfate (bisulfate), sulfuric acid, amidosulfonic acid, formic acid, oxalic acid, succinic acid, tartaric acid among others. But it is also possible to use mixtures of such acid agents which are capable of realizing the specific pH in accordance with the invention. However, if this process is carried out with weak organic acids, such as, for example, acetic acid, which merely permit the setting of pH values within the range from 4 to about 4.8, it is found again and again that the resulting fastness properties are not as good as to be expected from the use of strong acids. For that reason it is necessary in those cases to add urea to the liquor as well, as already explained in DE-C2 No. 2,635,989. By contrast, the invention provides that, if strong organic acids which bring about pH values of 2 to 3 are used, the addition of urea can be dispensed with. It was not foreseeable in this respect that the setting of very specific acid conditions permits a reduction in temperature in the pad-batchup process for the dyeing of wool with reactive dyes. This reduction in the dyeing temperature is incidentally so appreciable that a true cold-dwell fixation is present.

To prevent the appearance of frosting on the wool dyeings produced according to the invention, the aqueous padding liquor can if necessary also contain, in addition, nitrogen-containing ethoxylates or alkyl polyglycol ethers or a mixture of the two commercially available classes of compounds. This is because it was found according to the present invention that adding 5 to 25 g/l, preferably 10 to 15 g/l, of a 30 to 70% strength, aqueous formulation of fatty amines containing ethylene oxide groups, i.e. in particular of a reaction product of 1 mol of a fatty amine having 12 to 20 carbon atoms, preferably stearylamine, and 8 to 15 mol of ethylene oxide, or adding the same amount of an alkyl polyglycol ether, i.e. in particular of a reaction product of straight-chain or branched fatty alcohols having 10 to 18 carbon atoms, preferably 1 mol of isotridecyl alcohol, and 5 to 8 mol of ethylene oxide, to the dyeing liquor gives frosting-free, brilliant and deep shades. In addition to an increase in the brilliance owing to the absence of frosting it was also noticed here, surprisingly, that a distinct increase in the color strength occurs.

Suitable reactive dyes for dyeing wool fibers and the wool portion of fiber mixtures are the organic dyes known under this generic term—irrespectively of the nature of their fiber-reactive group. This class of dyes is designated in the Colour Index, 3rd edition, 1971 and supplements 1975 as "C.I. Reactive Dyes", and embraces chemical compounds of dye character which are capable of entering a covalent bond with OH- and/or NH-containing fibers. These are primarily dyes which contain at least one group which is reactive with hydroxyl or amino groups in the fiber material of polyamide structure, a precursor thereof, or a substituent which is reactive with the abovementioned constituents of the fiber molecule. Suitable basic structures of the chromophoric system of these organic dyes are in particular those from the series of the azo, anthraquinone and phthalocyanic compounds, where the azo and phthalocyanine dyes can be not only metalfree but also metal-containing. The reactive groups and precursors which form such reactive groups are for example epoxy groups, the ethyleneimide group, the vinyl grouping in the vinylsulfonyl or in the acrylic acid radical, and also the β-sulfatoethylsulfonyl group, the β-chloroethylsulfonyl group or the β-dialkylaminoethylsulfonyl group. Also suitable for this process are derivatives of the tetrafluorocyclobutyl series, for example of tetrafluorocyclobutylacrylic acid. Reactive substituents in reactive dyes are those substituents which are easily detachable and leave behind an electrophilic radical. Interesting substituents in this respect are for example 1 to 3 halogen atoms on the following ring systems: quinoxaline, triazine, pyrimidine, phthalazine, pyridazine and pyridazone. It is also possible to use dyes having a plurality of reactive groups of the same or a different kind. These reactive dyes of the previously defined kind frequently have more than one sulfo group (apart from the reactive grouping of the dye) in the molecule, which can be distributed over the chromophore in any desired manner, but are preferably bonded to the aromatic radicals thereon.

The present invention is preferably carried out with dyes of the vinylsulfonyl type, with which the fiber reacts by an addition mechanism via the vinylsulfonyl form of the dye. Similarly suitable coloring substances in the claimed process are the conversion products of such known sulfonyl reactive dyes with, for example, methyltaurine, in which the reactive group is temporarily present in a masked form.

By means of the dyeing technique of this invention it is possible to obtain satisfactory dyeing results not only on the customary wool fibers, i.e. wool fibers which have not been pretreated with an antifelting finish, but also on chlorinated wool materials or those which have been given a nonfelting or low-felting finish by applying a polyacrylic or polyimine resin film.

The claimed process is in general carried out as follows:

The wool textile to be dyed is padded at about room temperature with the padding liquor which contains dye, acid and possibly assistants. The wet pickup can be here, depending on the type of the textile material, between 50 and 130% on weight of dry fiber.

To obtain dye fixation, the moist material is then dwelled at about room temperature for 18 to 36 hours, which is customarily effected in the rolled-up state with slow rotation of the roller. Expediently this measure is effected in the substantial absence of air, which is obtained by wrapping the batched-up material in a plastic film. Given a suitably low wet pickup, the dwell process with the moist textile material can also be accomplished in the plaited state. Subsequently the completed dyeing is rinsed, washed and neutralized.

In the worked examples below, the percentages relate to the weight of the objects thus designated. The reactive dyes mentioned are used in the commercially available form and constitution:

EXAMPLE 1

(a) An aqueous padding liquor at about 20° C., which contains 10 g/l of a 4% strength, aqueous thickening based on galactomannan, 15 g/l of the dye Reactive Blue 19 having the C.I. No. 61,200 and 20 ml/l of concentrated (96% strength) sulfuric acid and has been brought to pH 2.8, is used to pad a fabric made of wool not pretreated with an antifelting finish. The wet pickup in the padding is 100% on weight of dry fiber. The material treated in this way is then batched up in the moist state resulting from squeezing off the excess liquor and is left to dwell at room temperature for 24 hours with slow rotation of the batching roller to obtain dye fixation. Thereafter the dyeing thus produced is washed off with water.

The result is a blue dyeing which has good to very good wet fastness properties, but which displays a frosting effect.

(b) If the dyeing liquor prepared under 1(a) also has added to it 15 g/l of a 30% strength aqueous formulation of the reaction product of 1 mol of stearylamine with 12 mol of ethylene oxide (with added triisobutyl phosphate as a defoamer) and the padding step and also the dwell operation to obtain dye fixation are carried out in accordance with the above method 1(a), a corresponding blue dyeing without the appearance of frosting is obtained.

If the color strength of the dyeing obtained in 1(a) was then for comparison determined in reflectance measurements by means of a colorimeter of the MM 7000 type from Instrumental Color Systems and set equal to 100, then by means of color measurements on the same basis in the case of the dyeing obtained as in 1(b) the color strength could be found to be 125.

(c) If, however, the dyeing liquor specified under 1(a) had added to it, instead of the substance as per 1(b), in this case 15 g/l of an aqueous solution of the reaction product of 1 mol of isotridecyl alcohol with 5 mol of ethylene oxide, then dyeing and finishing in accordance with method 1(a) produced in this case a particularly brilliant blue dyeing without frosting, which, on the basis of color measurements under the conditions specified there, had in comparison to the dyeing as per 1(a) (color strength = 100) a color strength of 211.

The same dyeing results as in 1(a), 1(b) and 1(c) are obtained on using 7 g/l of amidosulfonic acid, in place of sulfuric acid, and an otherwise identical composition of the padding liquor.

EXAMPLE 2

(a) An aqueous padding liquor of the composition specified in Example 1(a) except that instead of the blue dye used there it contains here 20 g/l of the yellow reactive dye of the formula

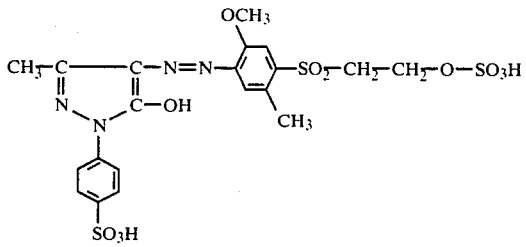

and instead of sulfuric acid 80 g/l of potassium hydrogensulfate, is used to pad at room temperature and pH 2.9 a wool flannel material without a nonfelting finish with a wet pickup of 95% (on weight of fiber). After a 20-hour dwell time to obtain dye fixation at 20° C. the rest of the procedure is as described in Example 1(a).

The result is a full yellow dyeing having very good wet fastness properties.

(b) If in preparing the above yellow dyeing the dyeing liquor made up as in 2(a) is used, however, with further addition of ethoxylated stearylamine as in Example 1(b), then finishing as per Example 1 gives a frosting-free dyeing having a color strength of 131, as determined colorimetrically against dyeing 2(a) (color strength = 100).

(c) If, however, dyeing liquor which is in accordance with 2(a) is used as described in Example 1(c), with further addition of ethoxylated isotridecyl alcohol, then a highly brilliant yellow dyeing having a colorimetrically determined strength value of 222 compared with the reference value of 100 from Example 2(a) is obtained.

EXAMPLE 3

(a) An aqueous padding liquor at about 20° C., which contains 10 g/l of a 4% strength aqueous thickening based on galactomannan, 15 g/l of the red reactive dye of the formula

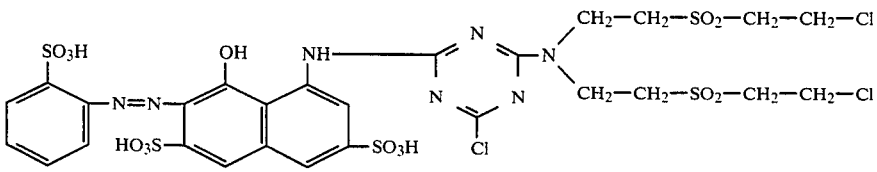

and 90 g/l of tartaric acid, is used to pad at pH 3 a wool fabric with a polyimine resin nonfelting finish with a wet pickup of 100% (on weight of fiber). After a 28-hour dwell time to obtain dye fixation at room temperature the rest of the procedure is as specified in Example 1a).

The result is a full red dyeing.

(b) If, however, in dyeing with the liquor of 3(a) 12 g/l of ethoxylated stearylamine are present as in Example 1(b), then the result is a brilliant red dyeing having a colorimetrically determined color strength of 151 compared with that of dyeing 3(a) having the reference value of 100.

(c) If dyeing liquor 3(a) has additionally added to it ethoxylated isotridecyl alcohol as in Example 1(c) and the procedure followed is as specified there, the result is, after finishing, a particularly brilliant red dye having a color strength of 164 compared with that of dyeing 3(a) = 100.

EXAMPLE 4

(a) An aqueous padding liquor at about 25° C., which contains 10 g/l of a 4% strength, aqueous thickening based on galactomannan, 30 g/l of the dye Reactive Orange 16 having the C.I. No. 17,757 and 20 ml/l of concentrated (96% strength) sulfuric acid, and has been brought to pH 2.5, is used to impregnate a wool fabric which has no nonfelting finish with a wet pick-up of 100% (on weight of fiber). After a batchup time of 24 hours at room temperature to obtain dye fixation and also finishing as described in Example 1(a) an orange-red dyeing having very good wet fastness properties is obtained.

(b) If, within the framework of the above dyeing method, ethoxylated stearylamine as in Example 1(b) is also added, the result is a corresponding dyeing having a measured depth of shade of 179, compared with that of dyeing 4(a) = 100.

(c) On adding the ethoxylated isotridecyl alcohol quoted in Example 1(c) to liquor 4(a) at otherwise identical dyeing conditions a particularly brilliant orange dyeing of depth of shade 224, compared with that of dyeing 4(a) = 100 is obtained.

EXAMPLE 5

(a) An aqueous liquor at room temperature which has the composition specified in Example 1(a), except that the yellow dye specified there is replaced here by 30 g/l of the commercially available (with added methyltaurine) red reactive dye of the formula

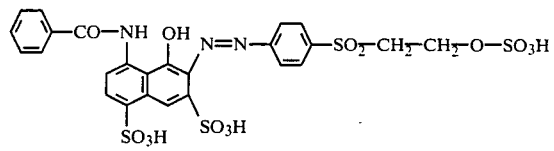

is used to pad a wool fabric with no nonfelting finish at pH 2.5 with a wet pickup of 100% (on weight of fiber). After a dwell time of the moist material of 24 hours at about 20° C., the textile material thus dyed is washed off with water. The result is a full red dyeing.

(b) If in preparing the above dye the ethoxylated stearylamine of Example 1(b) is also added the result is a deeper red dyeing than obtained in process 5(a), having a color strength of 126 compared with the color strength of 100 for dyeing 5(a).

(c) The addition of ethoxylated isotridecyl alcohol as specified in Example 1(c) to padding liquor 5(a) leads to a highly brilliant, deep red dyeing of color strength 188 compared with the dyeing of 5(a) having the reference value 100.

EXAMPLE 6

An aqueous padding liquor at room temperature, which contains 10 g/l of fully etherified (methylated) carob bean flour, 15 g/l of a 30% strength aqueous solution of the reaction product of 1 mol of stearylamine with 12 mol of ethylene oxide (with triisobutyl phosphate as defoamer), 40 g/l of the red reactive dye of the formula

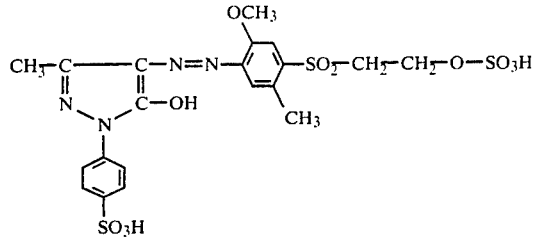

10 g/l of the yellow reactive dye of the formula

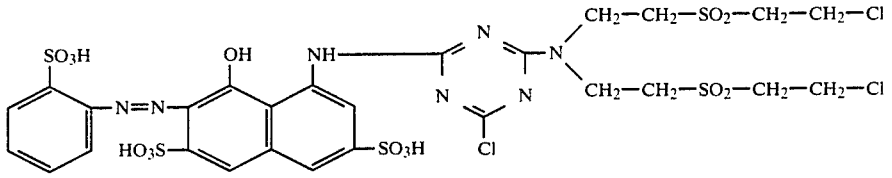

and 15 g/l of the red reactive dye of the formula

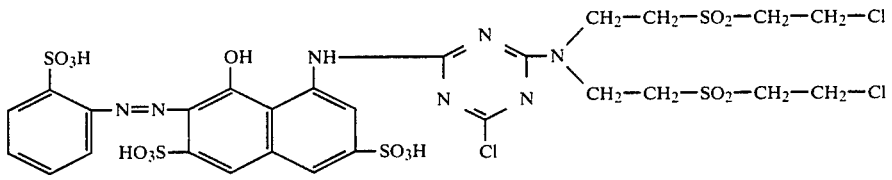

and also 15 g/l of the dye Reactive Blue 19 having the C.I. No. 61,200 and 25 ml/l of concentrated sulfuric acid is used for dyeing and dye fixation as specified in Example 6.

The result is a neutral gray having good to very good fastness properties.

We claim:

1. A pad cold-dwell process for dyeing piece goods made of wool or wool-containing fiber mixtures in an acid medium using reactive dyes, which comprises padding the weblike textile material at a pH value between 1.5 and 4 and at temperatures within the range of from about 20° to 25° C. with an aqueous liquor containing the dissolved reactive dyes but no urea and then, to fix the dyes, allowing this padded material to dwell for 18 to 36 hours in the moist state while maintaining the adjusted acid conditions and without further heat supply.

2. The process as claimed in claim 1, wherein the pH value of the padding liquor is between 2 and 3.

3. The process as claimed in claim 1, wherein the pH value of the padding liquor is set by adding at least one inorganic or organic acid and/or one of the acid salts thereof.

4. The process as claimed in claim 1, wherein the padding liquor additionally contains fatty amine ethoxylates or alkyl polyglycol ethers or a mixture of the two.

5. The process as claimed in claim 4, wherein the group of fatty amine ethoxylates is the reaction product of 1 mol of a fatty amine having 12 to 20 carbon atoms and 8 to 15 mol of ethylene oxide.

6. The process as claimed in claim 5, wherein the parent fatty amine of the ethoxylates is stearylamine.

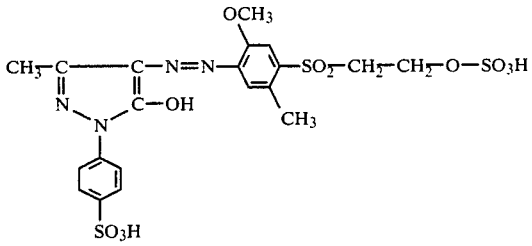

and 25 ml/l of concentrated sulfuric acid and has been brought to pH 2.6, is used to pad a wool fabric with no nonfelting finish with a wet pickup of 95% (on weight of fiber). After a 24-hour dwell time to obtain dye fixation at about 20° C., finishing is effected as described in Example 1(a).

The result is a brilliant highly red dyeing having very good wet fastness properties.

EXAMPLE 7

An aqueous padding liquor as described in Example 6, which instead of the dyes specified there contains here a mixture of 15 g/l of the yellow reactive dye of the formula 7. The process as claimed in claim 5, wherein the ethoxylated fatty amines are used in the form of a 30 to 70% strength, aqueous formulation.

8. The process as claimed in claim 4, wherein the group of the alkyl polyglycol ethers are the reaction products of straight-chain or branched fatty alcohols having 10 to 18 carbon atoms and 5 to 8 mol of ethylene oxide.

9. The process as claimed in claim 8, wherein the alkyl polyglycol ethers are the reaction products of 1 mol of isotridecyl alcohol with 5 to 8 mol of ethylene oxide.

10. The process as claimed in claim 4, wherein the fatty amine ethoxylates and/or alkyl polyglycol ethers are present in the padding liquors in amounts of 5 to 25 g/l.

11. The process as claimed in claim 1, wherein wool which has not been pretreated with an anti-felting finish is dyed.

12. The process as claimed in claim 1, wherein wool which has been pretreated by chlorination or given a low-felting or nonfelting finish by application of a polyimine resin or a polyacrylic resin is dyed.

13. The process as claimed in claim 10, wherein said amounts are from 10 to 15 g/l.

* * * * *